US009916836B2

(12) United States Patent
Mäkinen

(10) Patent No.: US 9,916,836 B2
(45) Date of Patent: Mar. 13, 2018

(54) REPLACING AN ENCODED AUDIO OUTPUT SIGNAL

(71) Applicant: Microsoft Technology Licensing, LLC, Redmond, WA (US)

(72) Inventor: Jorma Mäkinen, Tampere (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 24 days.

(21) Appl. No.: 14/665,848

(22) Filed: Mar. 23, 2015

(65) Prior Publication Data

US 2016/0284355 A1 Sep. 29, 2016

(51) Int. Cl.

| | |
|---|---|
| ***H04R 5/00*** | (2006.01) |
| ***G10L 19/008*** | (2013.01) |
| ***H04S 3/00*** | (2006.01) |
| ***G10L 21/00*** | (2013.01) |
| *H04R 3/00* | (2006.01) |
| *G10L 21/0216* | (2013.01) |

(52) U.S. Cl.

CPC ..... *G10L 19/008* (2013.01); *G10L 21/00* (2013.01); *H04S 3/008* (2013.01); *G10L 2021/02166* (2013.01); *H04R 3/005* (2013.01); *H04R 2499/11* (2013.01); *H04S 2400/01* (2013.01); *H04S 2400/15* (2013.01); *H04S 2420/03* (2013.01)

(58) Field of Classification Search

CPC ..... H04R 25/00; H04R 29/00; H04R 29/005; H04R 2201/401; H04R 2201/403; G10L 2021/02166; G10L 19/008; H04S 3/008; H04S 2400/01; H04S 2400/15; H04S 2420/03

USPC ..... 381/23, 56, 58, 91, 92, 94.2, 94.3

See application file for complete search history.

(56) References Cited

U.S. PATENT DOCUMENTS 5,982,447 A * 11/1999 Nakamura ..... G11B 27/034 348/513
6,904,152 B1 6/2005 Moorer
7,242,924 B2 7/2007 Xie
7,558,393 B2 7/2009 Miller, III (Continued)

FOREIGN PATENT DOCUMENTS

WO 2013102799 A1 7/2013

OTHER PUBLICATIONS

"International Search Report and Written Opinion Issued in PCT Application No. PCT/US2016/019004", dated May 19, 2016, 11 Pages.

(Continued)

*Primary Examiner* — William A Jerez Lora

(57) ABSTRACT

Replacement of an encoded audio output signal is disclosed. In one example, a data set comprising a first encoded audio output signal and associated pre-stored digital audio input signals captured with a microphone array of an apparatus is received. An intermediate audio signal is produced by applying an audio processing modification to the digital audio input signals. The audio processing modification utilizes apparatus specific information. The specific audio processing modification to use is determined based on user input or other information. The intermediate audio signal is encoded to produce a second encoded audio output signal. The first encoded audio output signal is replaced with the second encoded audio output signal in the data set.

20 Claims, 7 Drawing Sheets

(56) References Cited

U.S. PATENT DOCUMENTS

| | | | | |
|---|---|---|---|---|
| 8,284,951 | B2 | 10/2012 | Van Schaack et al. | |
| 8,503,716 | B2 | 8/2013 | Allen et al. | |
| 2007/0022869 | A1* | 2/2007 | Lechner | H04R 3/04 84/645 |
| 2010/0110232 | A1 | 5/2010 | Zhang et al. | |
| 2011/0069229 | A1 | 3/2011 | Lord | |
| 2012/0082319 | A1 | 4/2012 | Jot et al. | |
| 2012/0083910 | A1 | 4/2012 | Lloyd et al. | |
| 2012/0134511 | A1* | 5/2012 | Vilermo | G10L 19/008 381/107 |
| 2013/0343549 | A1* | 12/2013 | Vemireddy | H04R 5/027 381/17 |
| 2014/0038670 | A1 | 2/2014 | Goldstein et al. | |
| 2014/0039883 | A1 | 2/2014 | Yang et al. | |
| 2014/0105416 | A1 | 4/2014 | Huttunen et al. | |
| 2014/0126726 | A1* | 5/2014 | Heiman | H04R 3/005 381/26 |
| 2014/0126751 | A1* | 5/2014 | Yliaho | H04R 3/00 381/122 |
| 2014/0241702 | A1 | 8/2014 | Solbach et al. | |
| 2015/0050967 | A1* | 2/2015 | Bao | H04M 9/082 455/570 |
| 2015/0127354 | A1* | 5/2015 | Peters | G10L 19/008 704/500 |

OTHER PUBLICATIONS

Yang, et al., "A 3D Audio Coding Technique based on Extracting the Distance Parameter", In IEEE International Conference on Multimedia and Expo, Jul. 14, 2014, 6 pages.

Alexandridis, et al., "Directional Coding of Audio Using a Circular Microphone Array", In IEEE International Conference on Acoustics, Speech and Signal Processing, May 26, 2013, 5 pages.

"Second Written Opinion Issued in PCT Application No. PCT/US2016/019004", dated Feb. 15, 2017, 5 Pages.

"International Preliminary Report on Patentability Issued in PCT Application No. PCT/US2016/019004", dated May 31, 2017, 8 Pages.

* cited by examiner

REPLACING AN ENCODED AUDIO OUTPUT SIGNAL

BACKGROUND

Various digital video cameras and mobile apparatuses, such as smartphones and tablet computers incorporating digital cameras, may have two or more microphones for audio recording. The microphones may be placed in such a way that allows implementing several audio recording modes, such as stereo or surround sound recording. The user interface makes it possible to select a recording mode and other audio recording parameters, such as enabling and disabling high-pass filtering. However, the user may not always have time to select optimal settings, e.g. in ad hoc situations. Furthermore, selection of optimal settings may be difficult in loud or noisy conditions because monitoring of audio is unfeasible or unsupported.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Replacement of an encoded audio output signal is described. In one example, a method comprises receiving a data set comprising a first encoded audio output signal and associated pre-stored digital audio input signals captured with a microphone array of an apparatus, the digital audio input signals having been previously utilized as input for the first encoded audio output signal; applying an audio processing modification to the received digital audio input signals utilizing apparatus specific information, to produce an intermediate audio signal; encoding the intermediate audio signal to produce a second encoded audio output signal; and replacing the first encoded audio output signal with the second encoded audio output signal in the data set.

In another example an apparatus and a computer-readable storage medium have been discussed along with the features of the method.

Many of the attendant features will be more readily appreciated as the same becomes better understood by reference to the following detailed description considered in connection with the accompanying drawings.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

Although some of the present examples may be described and illustrated herein as being implemented in a mobile phone, a smartphone or a tablet computer, these are only examples of an apparatus and not a limitation. As those skilled in the art will appreciate, the present examples are suitable for application in a variety of different types of apparatuses incorporating a digital audio recording module with multiple microphones, for example, a stand-alone digital video camera device.

Figure 1:
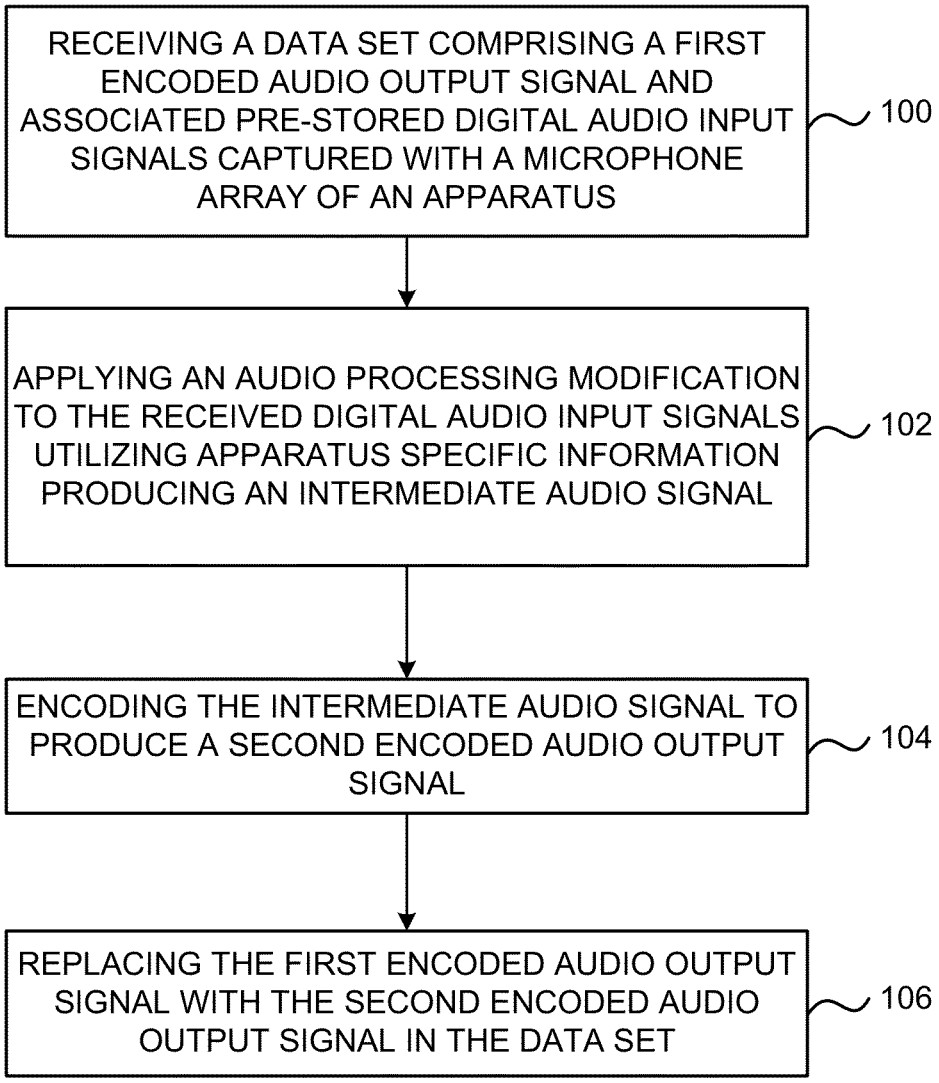
FIG. 1 is a flow diagram of one example of a method.

FIG. 1 shows a method which can be used to replace a first encoded audio output signal with a second encoded audio output signal that is generated from the same digital audio input signals captured with a microphone array as the first encoded audio output signal but with different audio processing modification(s) applied. For example, the first audio output signal may not have optimal quality so it may be beneficial to replace it with a second audio output signal of better quality. For example, in ad hoc situations (e.g. a live concert recording or a meeting with friends) the user may have been in a hurry and did not have enough time to select optimal settings for the audio processing modification(s).

At step 100, a data set comprising a first encoded audio output signal and associated pre-stored digital audio input signals captured with a microphone array of an apparatus is received at a unit of the apparatus. Herein, "pre-stored" indicates that the digital audio input signals are not received in real-time from the microphone array. Rather, they have been first stored in a memory from which they are then received. The digital audio input signals have been previously utilized as input for the first encoded audio signal. At step 102, an intermediate audio signal is produced by a unit of the apparatus. To produce the intermediate audio signal, an audio processing modification is applied to the received digital audio input signals. The audio processing modification utilizes apparatus specific information, such as information about a configuration of the microphone array and about apparatus acoustics. In an example, the microphone array configuration is fixed. In an example, the specific audio processing modification to use is determined based on user input. In another example, the audio processing modification to use is determined based on other information, e.g. information about device configuration, information about how the device is currently being used, or the like. A processor or the like may automatically select the modification to use without user input. The intermediate audio signal is encoded by a unit of the apparatus to produce a second encoded audio output signal, step 104. The encoding may comprise e.g. advanced audio coding (AAC), dolby digital plus encoding (DD+) or the like. The first encoded audio output signal is replaced with the second encoded audio output signal in the data set by a unit of the apparatus, 106. As a result, the second encoded audio output signal may provide improved audio, including, but not limited to, quality, encoding, and the like.

Figure 2:
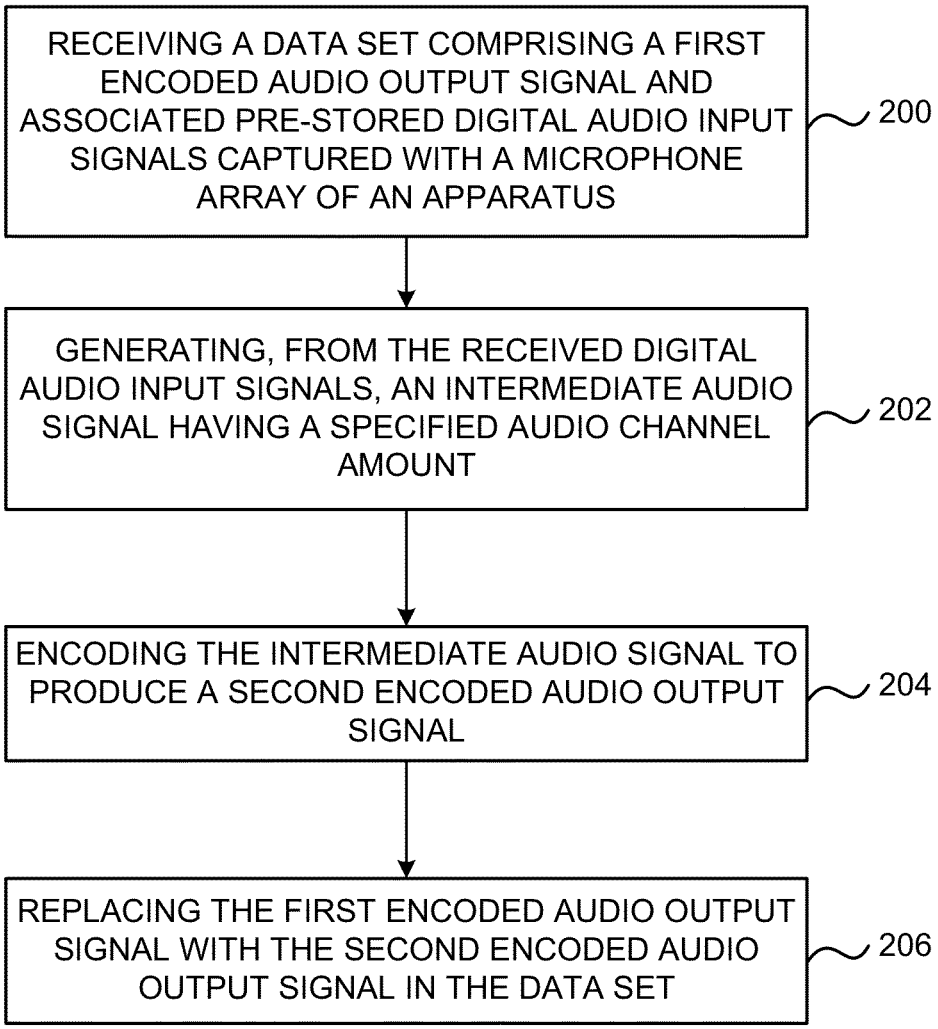
FIG. 2 is a flow diagram of another example of a method.

FIG. 2 shows another method which can be used to replace a first encoded audio output signal with a second encoded audio output signal that is generated from the same digital audio input signals captured with a microphone array as the first encoded audio output signal but with different audio processing modification(s) applied.

At step 200, a data set comprising a first encoded audio output signal and associated pre-stored digital audio input signals captured with a microphone array of an apparatus is received at a unit of the apparatus. The digital audio input signals have been previously utilized as input for the first encoded audio signal. In step 202, an intermediate audio signal is produced by a unit of the apparatus. To produce the intermediate audio signal, an audio processing modification is applied to the received digital audio input signals. The audio processing modification comprises generating, from the received digital audio input signals, the intermediate audio signal having an audio channel amount specified e.g. by the user input. The audio channel amount may include e.g. two channels for stereo sound and at least three channels for surround sound. In another example, the audio channel amount may be derived from device requirements, operating conditions, or the like. A processor or the like may automatically select the audio channel amount without user input. The audio processing modification utilizes apparatus specific information about a configuration of the microphone array and about apparatus acoustics. The intermediate audio signal is encoded by a unit of the apparatus to produce a second encoded audio output signal, step 204. The encoding may comprise e.g. advanced audio coding (AAC), dolby digital plus encoding (DD+) or the like. The first encoded audio output signal is replaced with the second encoded audio output signal in the data set by a unit of the apparatus, step 206.

Figure 3:
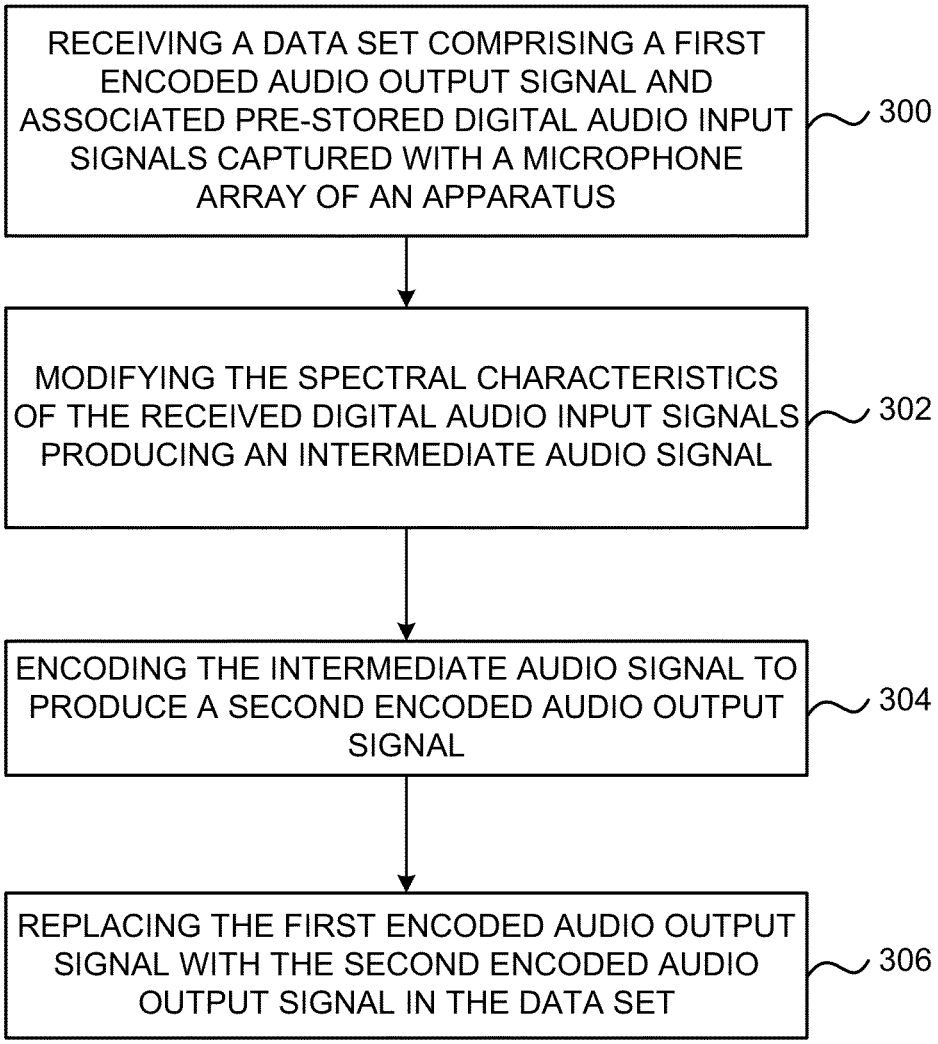
FIG. 3 is a flow diagram of another example of a method.

FIG. 3 shows another method which can be used to replace a first encoded audio output signal with a second encoded audio output signal that is generated from the same digital audio input signals captured with a microphone array as the first encoded audio output signal but with different audio processing modification(s) applied.

At step 300, a data set comprising a first encoded audio output signal and associated pre-stored digital audio input signals captured with a microphone array of an apparatus is received at a unit of the apparatus. The digital audio input signals have been previously utilized as input for the first encoded audio signal. At step 302, an intermediate audio signal is produced by a unit of the apparatus. To produce the intermediate audio signal, an audio processing modification is applied to the received digital audio input signals. The audio processing modification comprises modifying the spectral characteristics of the received digital audio input signals based e.g. on the user input. In another example, the modification of the spectral characteristics may be based on other information, e.g. information about device configuration, information about how the device is currently being used, device requirements, operating conditions, recording space conditions, or the like. A processor or the like may automatically select the modification to use without user input. The modification of the spectral characteristics may comprise e.g. high-pass filtering the received digital audio input signals. The audio processing modification utilizes apparatus specific information about a configuration of the microphone array and about apparatus acoustics. The intermediate audio signal is encoded by a unit of the apparatus to produce a second encoded audio output signal, step 304. The encoding may comprise e.g. advanced audio coding (AAC), dolby digital plus encoding (DD+) or the like. The first encoded audio output signal is replaced with the second encoded audio output signal in the data set by a unit of the apparatus, step 306.

Figure 4:
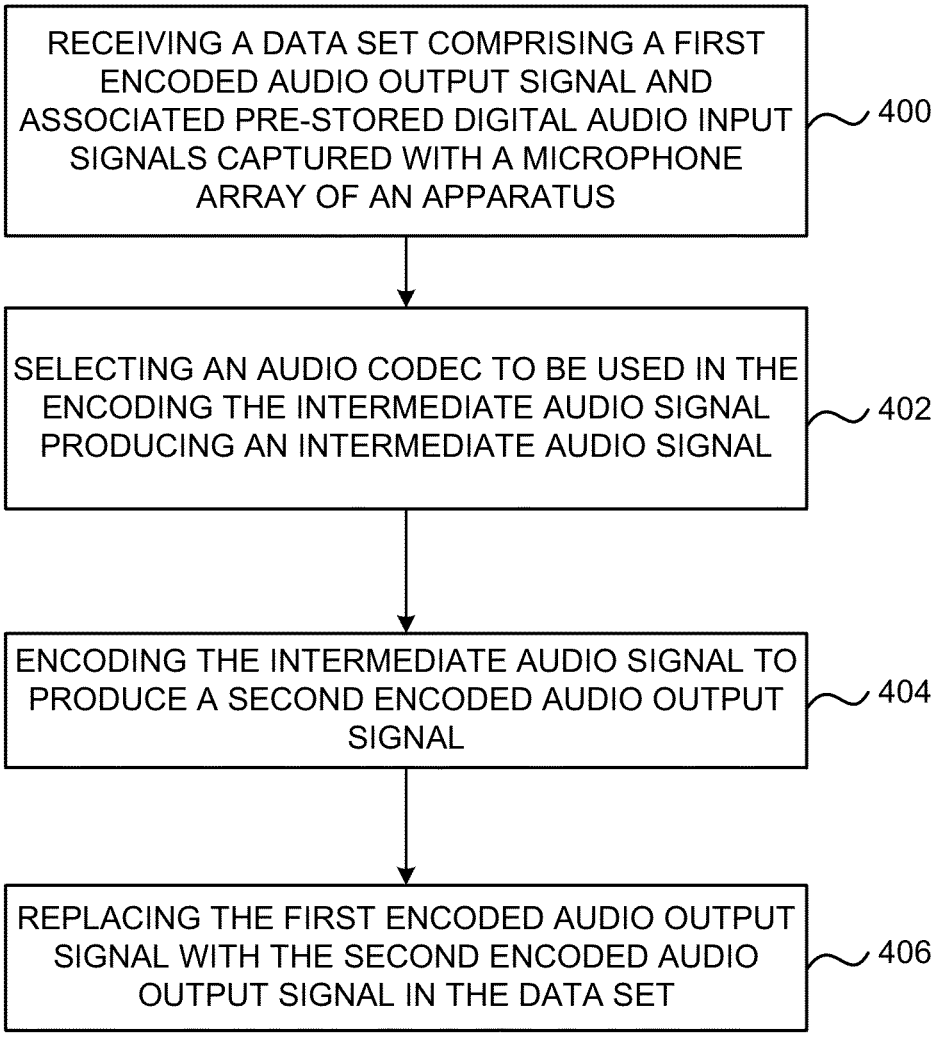
FIG. 4 is a flow diagram of another example of a method.

FIG. 4 shows another method which can be used to replace a first encoded audio output signal with a second encoded audio output signal that is generated from the same digital audio input signals captured with a microphone array as the first encoded audio output signal but with different audio processing modification(s) applied.

At step 400, a data set comprising a first encoded audio output signal and associated pre-stored digital audio input signals captured with a microphone array of an apparatus is received at a unit of the apparatus. The digital audio input signals have been previously utilized as input for the first encoded audio signal. At step 402, an intermediate audio signal is produced by a unit of the apparatus. To produce the intermediate audio signal, an audio processing modification is applied to the received digital audio input signals. The audio processing modification comprises selecting an audio codec to be used in the encoding the intermediate audio signal based on e.g. user input. In another example, the selection of the audio codec may be based on other information, e.g. information about device configuration, information about how the device is currently being used, device requirements, operating conditions, capabilities of available playback equipment, or the like. A processor or the like may automatically select the audio codec to use without user input. The audio processing modification utilizes apparatus specific information about a configuration of the microphone array and about apparatus acoustics. The intermediate audio signal is encoded by a unit of the apparatus to produce a second encoded audio output signal, step 404. The encoding may comprise e.g. advanced audio coding (AAC), dolby digital plus encoding (DD+), or the like. The first encoded audio output signal is replaced with the second encoded audio output signal in the data set by a unit of the apparatus, step 406.

At least some of the examples of FIGS. 1-4 may be performed e.g. at least in part by the apparatus having the microphone array or by a service providing network based storage.

Figure 5:
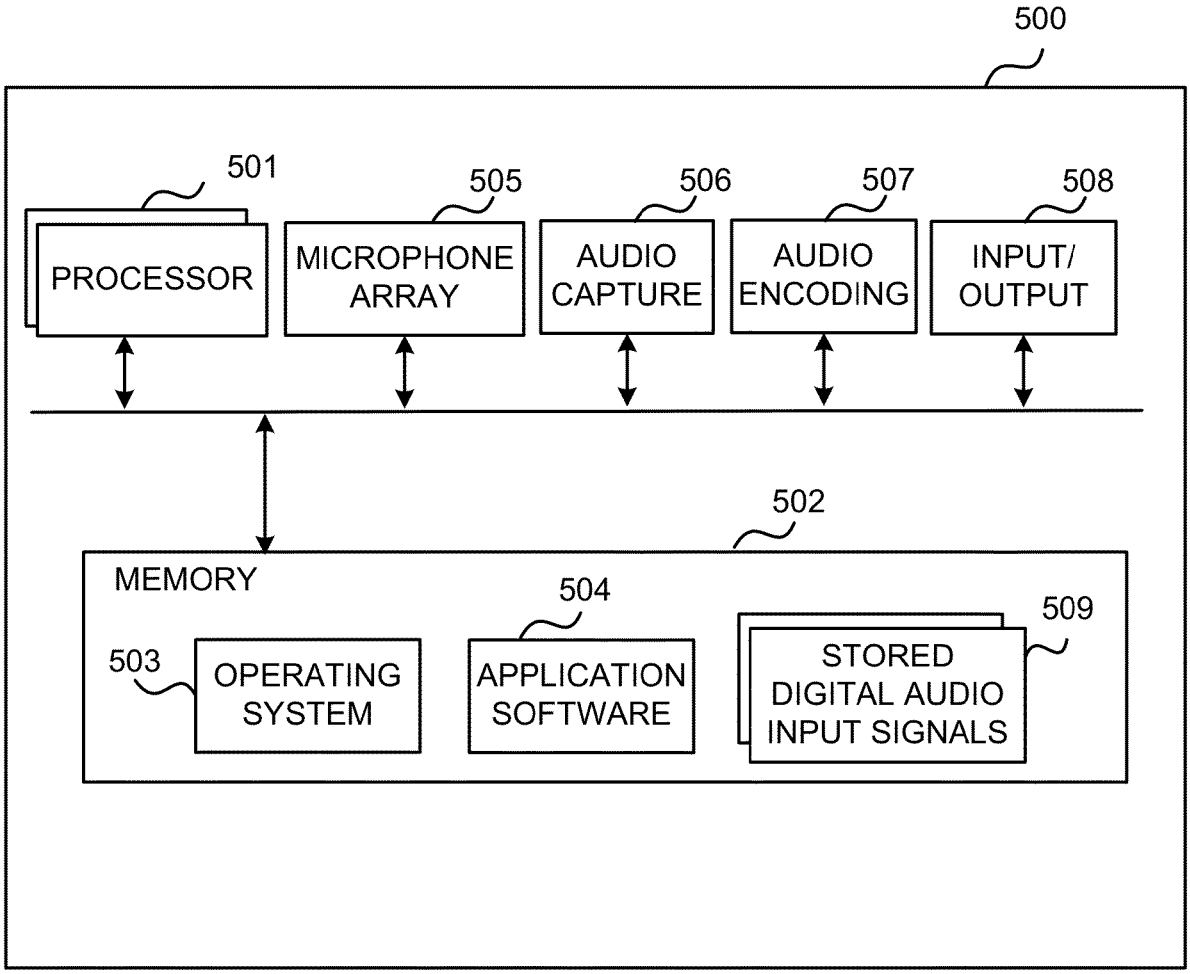
FIG. 5 is a block diagram of one example of an apparatus.

FIG. 5 shows a block diagram of one example of an apparatus 500 which may be implemented as any form of a computing device and/or electronic device that incorporates a digital audio recording module with multiple microphones. For example, the apparatus 500 may be implemented as a mobile phone, a smartphone, or a tablet computer. Alternatively, the apparatus 500 may be implemented e.g. as a stand-alone digital video camera device.

The apparatus 500 comprises a microphone array 505. The microphone array 505 may comprise at least two microphones. The apparatus 500 further comprises an audio capture unit 506. The audio capture unit 506 is configured to receive a data set comprising a first encoded audio output signal and associated pre-stored (e.g. in memory 502) digital audio input signals 509 captured with the microphone array 505. The digital audio input signals 509 have been previously utilized as input for the first encoded audio signal.

The audio capture unit 506 is further configured to apply an audio processing modification to the received digital audio input signals 509 utilizing apparatus 500 specific information about a configuration of the microphone array 505 and about apparatus acoustics of the apparatus 500. The specific audio processing modification to be applied is determined based on e.g. user input. In another example, the audio processing modification to use is determined based on other information, e.g. information about device configuration, information about how the device is currently being used, device requirements, operating conditions or the like. A processor or the like may automatically select the modification to use without user input. As a result of the applied audio processing modification, an intermediate audio signal is produced.

The audio processing modification performed by the audio capture unit 506 may comprise at least one of: generating, from the received digital audio input signals 509, the intermediate audio signal having an audio channel amount specified by the user input; modifying the spectral characteristics of the received digital audio input signals 509 based on e.g. the user input; and selecting an audio codec to be used in the encoding the intermediate audio signal based e.g. on user input. In another example, the audio channel amount may be derived from device requirements, operating conditions, or the like. A processor or the like may automatically select the audio channel amount without user input. The audio channel amount may include two channels for stereo sound and at least three channels for surround sound. In another example, the modification of the spectral characteristics may be based on other information, e.g. information about device configuration, information about how the device is currently being used, device requirements, operating conditions, recording space conditions, or the like. A processor or the like may automatically select the modification to use without user input. The modification of the spectral characteristics may comprise high-pass filtering the received digital audio input signals 509. In another example, the selection of the audio codec may be based on other information, e.g. information about device configuration, information about how the device is currently being used, device requirements, operating conditions, capabilities of available playback equipment, or the like. A processor or the like may automatically select the audio codec to use without user input.

The apparatus 500 further comprises an audio encoding unit 507. The audio encoding unit 507 is configured to encode the intermediate audio signal to produce a second encoded audio output signal. The audio encoding unit 507 may be configured to perform the encoding of the intermediate audio signal utilizing e.g. one of advanced audio coding (AAC) and dolby digital plus (DD+) encoding or the like.

The apparatus 500 further comprises an input/output unit 508. The input/output unit 508 is configured to replace the first encoded audio output signal with the second encoded audio output signal in the data set.

The apparatus 500 may comprise one or more processors 501 which may be microprocessors, controllers or any other suitable type of processors for processing computer executable instructions to control the operation of the apparatus 500. Platform software comprising an operating system 503 or any other suitable platform software may be provided at the apparatus 500 to enable application software 504 to be executed on the device. The application software 504 may include e.g. software configured to provide a graphical user interface for entering the user input in the examples of FIGS. 1-7.

Figure 6:
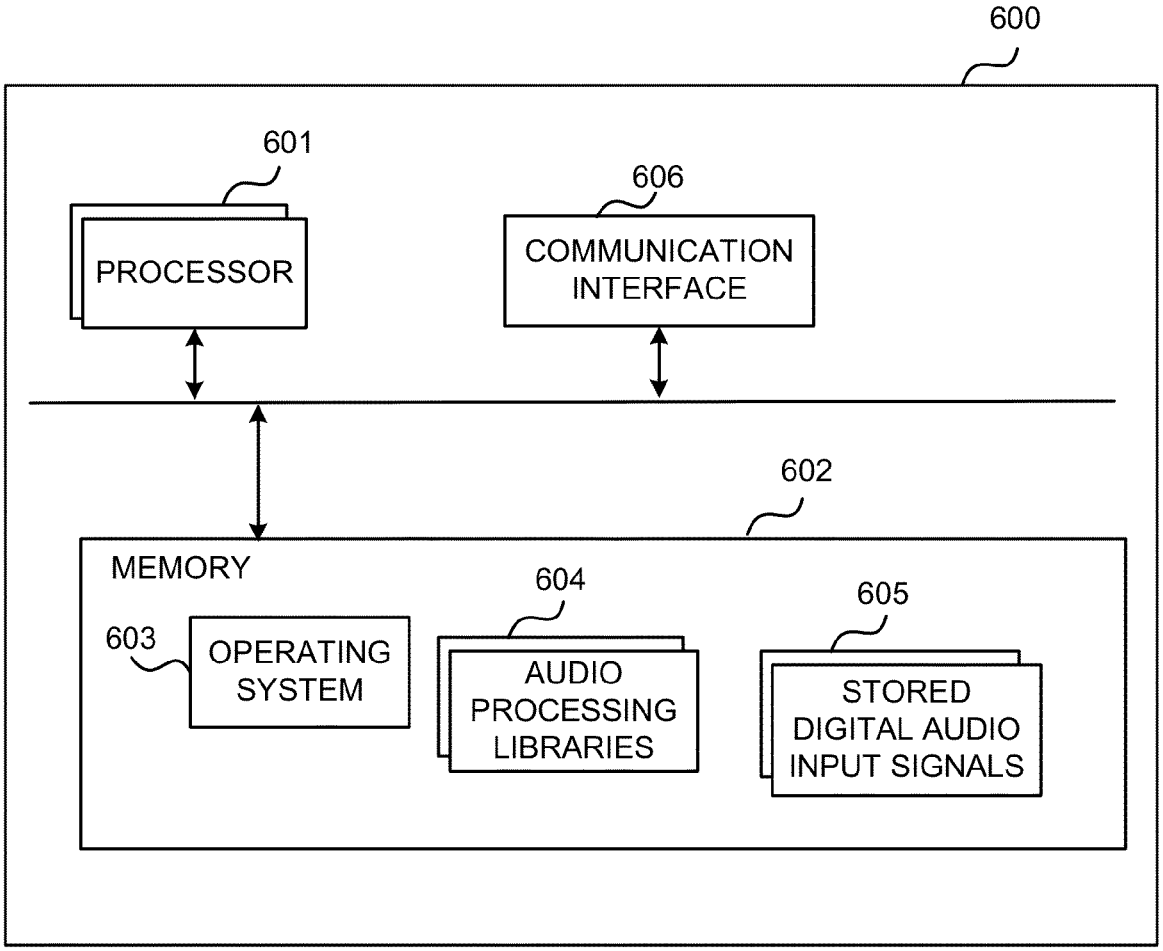
FIG. 6 is a block diagram of another example of an apparatus.

FIG. 6 shows a block diagram of one example of an apparatus 600 which may be implemented as any form of a computing device and/or electronic device that provides a network based storage service. For example, the apparatus 600 may be implemented as a server computer, such as a server computer providing cloud based file storage service.

The apparatus 600 comprises one or more processors 601 which may be microprocessors, controllers or any other suitable type of processors for processing computer executable instructions to control the operation of the apparatus 600. Platform software comprising an operating system 603 or any other suitable platform software may be provided at the apparatus 600.

The apparatus 600 further comprises a communication interface 606. The communication interface 606 is configured to receive a data set comprising a first encoded audio output signal and associated digital audio input signals captured with the microphone array 505 of the apparatus 500 of FIG. 5. The digital audio input signals have been previously utilized by the apparatus 500 of FIG. 5 as input for the first encoded audio output signal. The data set including the digital audio input signals 605 are stored in the memory 602. As discussed below in more detail, the data set may further comprise a video signal captured with the apparatus 500 and associated with the first encoded audio output signal. In such a case, the data set may comprise an mpeg-4 data set (i.e. an mp4 container file) or the like. In case of the data set comprising a container file, such as an mp4 file, the container file may comprise the video signal as a video stream, the first encoded audio output signal as a default audio stream, and the digital audio input signals as an alternative audio stream. The data set may further include an identifier or a type indicator of the apparatus 500, e.g. as metadata.

Based on the identifier or the type indicator of the apparatus 500, the apparatus 600 is configured to select an audio processing modification appropriate to the apparatus 500. For example, the apparatus 600 may be configured to select an audio processing library 604 corresponding to the identifier or the type indicator of the apparatus 500. Utilizing the selected audio processing library 604, the apparatus 600 is further configured to cause applying an audio processing modification to the received digital audio input signals utilizing apparatus 500 specific information about a fixed configuration of the microphone array 505 and about apparatus 500 acoustics, the audio processing modification determined based on e.g. user input, to produce an intermediate audio signal. The user input may be received by the apparatus 600 with the data set or separately. In another example, the audio processing modification to use is determined automatically based on other information, e.g. information about device configuration, information about how the device is currently being used, device requirements, operating conditions or the like. The apparatus 600 is further configured to cause encoding the intermediate audio signal to produce a second encoded audio output signal, and replacing the first encoded audio output signal with the second encoded audio output signal in the data set.

As with the apparatus 500 of FIG. 5, the audio processing modification performed by the apparatus 600 may comprise at least one of: generating, from the stored digital audio input signals 605, the intermediate audio signal having an audio channel amount specified by e.g. the user input; modifying the spectral characteristics of the stored digital audio input signals 605 based on e.g. the user input; and selecting an audio codec to be used in the encoding the intermediate audio signal based on e.g. user input. In another example, the audio channel amount may be automatically derived from device requirements, operating conditions, or the like. The audio channel amount may include two channels for stereo sound and at least three channels for surround sound. In another example, the modification of the spectral characteristics may be based on other information, e.g. information about device configuration, information about how the device is currently being used, device requirements, operating conditions, recording space conditions, or the like. The modification of the spectral characteristics may comprise high-pass filtering the received digital audio input signals 509. In another example, the selection of the audio codec may be based on other information, e.g. information about device configuration, information about how the device is currently being used, device requirements, operating conditions, capabilities of available playback equipment, or the like.

Computer executable instructions may be provided using any computer-readable media that is accessible by the apparatuses 500, 600. Computer-readable media may include, for example, computer storage media such as memories 502, 602 and communications media. Computer storage media, such as memories 502, 602, includes volatile and non-volatile, removable and non-removable media implemented in any method or technology for storage of information such as computer readable instructions, data structures, program modules or other data. Computer storage media includes, but is not limited to, RAM, ROM, EPROM, EEPROM, flash memory or other memory technology, CD-ROM, digital versatile disks (DVD) or other optical storage, magnetic cassettes, magnetic tape, magnetic disk storage or other magnetic storage devices, or any other non-transmission medium that can be used to store information for access by a computing device. In contrast, communication media may embody computer readable instructions, data structures, program modules, or other data in a modulated data signal, such as a carrier wave, or other transport mechanism. As defined herein, computer storage media does not include communication media. Therefore, a computer storage medium should not be interpreted to be a propagating signal per se. Propagated signals may be present in a computer storage media, but propagated signals per se are not examples of computer storage media. Although the computer storage media (memories 502, 602) is shown within the apparatuses 500, 600 it will be appreciated that the storage may be distributed or located remotely and accessed via a network or other communication link.

Figure 7:
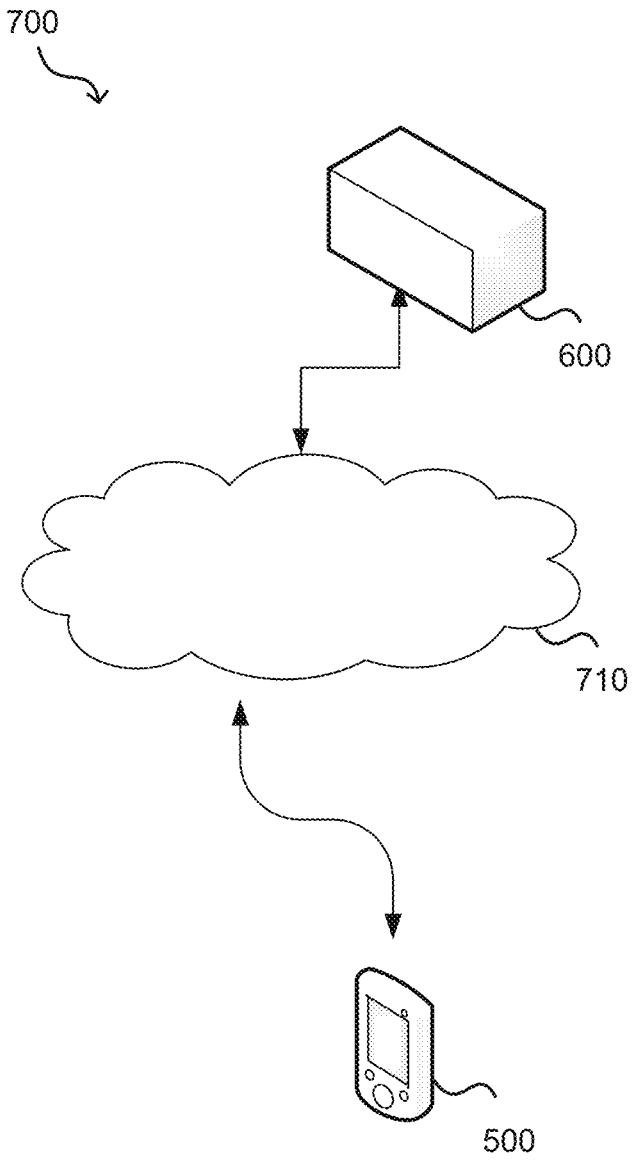
FIG. 7 is a diagram of one example of a system.

FIG. 7 shows a diagram of one example of a system 700. The system 700 comprises the apparatus 500, a network 710 and the apparatus 600 providing network based storage, such as cloud storage. The network 710 may include wired and/or wireless communication networks.

In the examples of FIGS. 1-7, the data set may further comprise a video signal captured with the apparatus and associated with the first encoded audio output signal. In such a case, the data set may comprise an Mpeg-4 (moving picture experts group-4) data set, such as an MPEG-4 Part 14 data set (i.e. an mp4 container file) or the like. Furthermore, the digital audio input signals may comprise one of uncompressed and lossless compressed digital audio input signals. The uncompressed digital audio input signals may comprise pulse code modulation (PCM) signals. In case of the data set comprising a container file, such as an mp4 file, the container file may comprise the video signal as a video stream, the first encoded audio output signal as a default audio stream, and the digital audio input signals as an alternative audio stream before the processing in the examples of FIGS. 1-7. Storing the digital audio input signals in a same container with the first encoded audio output signal may facilitate using correct digital audio input signals. As a result of the processing of the examples of FIGS. 1-7, the second encoded audio output signal will replace the first encoded audio output signal as the default audio stream.

At least some of the examples of FIGS. 1-7 may utilize information about microphone setup, the dimensions of the apparatus and/or the effect of microphones and microphone sound ports. This information is specific to the apparatus with the microphone array. The information may comprise e.g. information related to how the apparatus may shadow the audio signal differently for different microphones. The audio processing modification to be applied may utilize e.g. beamforming, performing a directional analysis on the digital audio input signals from the multiple microphones of the microphone array, performing a directional analysis on sub-bands for frequency-domain digital audio input signals from the multiple microphones of the microphone array, and/or frequency band specific optimizations.

It may be beneficial to take into account shadowing effects and device acoustics while implementing directional capture processing in small portable devices. In small portable devices, such as phones, the number of microphones available for the audio capture system is limited. In addition, there are a lot of limitations for microphone positions. Other components, like a touch screen, and other constraints, such as the likelihood of muting microphones by hands, may dictate the selection of microphone locations.

At the same time, the audio capture system may implement different recording modes. For example, when the main camera of a phone is used, the directional stereo recording should be aligned accordingly. If a user enables the secondary camera on the other side of the device, also the focus of the audio recording should be altered. In surround sound modes, the audio capture system may need to focus on e.g. five or seven directions. In practice, free field conditions cannot be assumed while implementing directional processing like beamformer solutions. Therefore, it may be beneficial to take into account the effect of the device on sound propagation between the microphones.

At least some of the examples disclosed in FIGS. 1-7 are able to provide replacing a first encoded audio output signal with a second encoded audio output signal that is generated from the same digital audio input signals captured with a microphone array than the first encoded audio output signal but with different audio processing modification(s) applied.

At least some of the examples disclosed in FIGS. 1-7 are able to provide changing recording modes (e.g. stereo or surround sound recording) and other parameters afterwards easily, intuitively and at an uncompromised audio quality. This also applies to audio features that require device specific processing.

At least some of the examples disclosed in FIGS. 1-7 are able to provide reusing the existing audio processing functions, including features that are device specific.

An embodiment of a method comprises receiving a data set comprising a first encoded audio output signal and associated pre-stored digital audio input signals captured with a microphone array of an apparatus, the digital audio input signals having been previously utilized as input for the first encoded audio output signal; applying an audio processing modification to the received digital audio input signals utilizing apparatus specific information, to produce an intermediate audio signal; encoding the intermediate audio signal to produce a second encoded audio output signal; and replacing the first encoded audio output signal with the second encoded audio output signal in the data set.

In an embodiment, alternatively or in addition, the apparatus specific information comprises information about a configuration of the microphone array and about apparatus acoustics.

In an embodiment, alternatively or in addition, the audio processing modification comprises at least one of: generating, from the received digital audio input signals, the intermediate audio signal having a specified audio channel amount; modifying the spectral characteristics of the received digital audio input signals; and selecting an audio codec to be used in the encoding the intermediate audio signal.

In an embodiment, alternatively or in addition, the audio channel amount includes two channels for stereo sound and at least three channels for surround sound.

In an embodiment, alternatively or in addition, the modifying the spectral characteristics comprises high-pass filtering the received digital audio input signals.

In an embodiment, alternatively or in addition, the encoding the intermediate audio signal comprises one of advanced audio coding the intermediate audio signal and dolby digital plus encoding the intermediate audio signal.

In an embodiment, alternatively or in addition, the data set further comprises a video signal captured with the apparatus and associated with the first encoded audio output signal.

In an embodiment, alternatively or in addition, the method is performed by the apparatus having the microphone array.

In an embodiment, alternatively or in addition, the method is performed by a service providing network based storage.

In an embodiment, alternatively or in addition, the digital audio input signals comprise one of uncompressed and lossless compressed digital audio input signals.

In an embodiment, alternatively or in addition, the uncompressed digital audio input signals comprise pulse code modulation signals.

In an embodiment, alternatively or in addition, the data set comprises MPEG-4 data set.

An embodiment of an apparatus comprises a microphone array; an audio capture unit configured to receive a data set comprising a first encoded audio output signal and associated pre-stored digital audio input signals captured with the microphone array, the digital audio input signals having been previously utilized as input for the first encoded audio signal; and to apply an audio processing modification to the received digital audio input signals utilizing apparatus specific information, to produce an intermediate audio signal; an audio encoding unit configured to encode the intermediate audio signal to produce a second encoded audio output signal; and an input/output unit configured to replace the first encoded audio output signal with the second encoded audio output signal in the data set.

In an embodiment, alternatively or in addition, the apparatus specific information comprises information about a configuration of the microphone array and about apparatus acoustics.

In an embodiment, alternatively or in addition, the audio processing modification performed by the audio capture unit comprises at least one of: generating, from the received digital audio input signals, the intermediate audio signal having a specified audio channel amount; modifying the spectral characteristics of the received digital audio input signals; and selecting an audio codec to be used in the encoding the intermediate audio signal.

In an embodiment, alternatively or in addition, the audio channel amount includes two channels for stereo sound and at least three channels for surround sound, and the modifying the spectral characteristics comprises high-pass filtering the received digital audio input signals.

In an embodiment, alternatively or in addition, the audio encoding unit is configured to perform the encoding of the intermediate audio signal utilizing one of advanced audio coding and dolby digital plus encoding.

In an embodiment, alternatively or in addition, the data set further comprises a video signal captured with the apparatus and associated with the first encoded audio output signal.

In an embodiment, alternatively or in addition, the digital audio input signals comprise one of uncompressed and lossless compressed digital audio input signals.

In an embodiment, alternatively or in addition, the microphone array comprises at least two microphones.

In an embodiment, alternatively or in addition, the apparatus comprises a mobile communication device.

An embodiment of a computer-readable storage medium comprising executable instructions for causing at least one processor of an apparatus to perform operations comprising: receiving a data set comprising a first encoded audio output signal and associated pre-stored digital audio input signals captured with a microphone array of an apparatus, the digital audio input signals having been previously utilized as input for the first encoded audio output signal; applying an audio processing modification to the received digital audio input signals utilizing apparatus specific information, to produce an intermediate audio signal; encoding the intermediate audio signal to produce a second encoded audio output signal; and replacing the first encoded audio output signal with the second encoded audio output signal in the data set.

The term 'computer' or 'computing-based device' is used herein to refer to any device with processing capability such that it can execute instructions. Those skilled in the art will realize that such processing capabilities are incorporated into many different devices and therefore the terms 'computer' and 'computing-based device' each include mobile telephones (including smart phones), tablet computers and many other devices.

The methods described herein may be performed by software in machine readable form on a tangible storage medium e.g. in the form of a computer program comprising computer program code means adapted to perform all the steps of any of the methods described herein when the program is run on a computer and where the computer program may be embodied on a computer readable medium. Examples of tangible storage media include computer storage devices comprising computer-readable media such as disks, thumb drives, memory etc. and do not include propagated signals. Propagated signals may be present in a tangible storage media, but propagated signals per se are not examples of tangible storage media. The software can be suitable for execution on a parallel processor or a serial processor such that the method steps may be carried out in any suitable order, or simultaneously.

This acknowledges that software can be a valuable, separately tradable commodity. It is intended to encompass software, which runs on or controls "dumb" or standard hardware, to carry out the desired functions. It is also intended to encompass software which "describes" or defines the configuration of hardware, such as HDL (hardware description language) software, as is used for designing silicon chips, or for configuring universal programmable chips, to carry out desired functions.

Those skilled in the art will realize that storage devices utilized to store program instructions can be distributed across a network. For example, a remote computer may store an example of the process described as software. A local or terminal computer may access the remote computer and download a part or all of the software to run the program. Alternatively, the local computer may download pieces of the software as needed, or execute some software instructions at the local terminal and some at the remote computer (or computer network). Those skilled in the art will also realize that by utilizing conventional techniques known to those skilled in the art that all, or a portion of the software instructions may be carried out by a dedicated circuit, such as a DSP, programmable logic array, or the like.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (ASICs), Application-specific Standard Products (ASSPs), System-on-a-chip systems (SOCs), Complex Programmable Logic Devices (CPLDs), and the like.

Any range or device value given herein may be extended or altered without losing the effect sought, as will be apparent to the skilled person.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims, and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

The term 'comprising' is used herein to mean including the method blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification. In particular, the individual features, elements, or parts described in the context of one example, may be connected in any combination to any other example also.

The invention claimed is:

1. A method, comprising:

receiving a data set comprising a first encoded audio output signal and associated pre-stored digital audio input signals captured from a microphone array of an apparatus that captures the digital audio input signals using direct audio capture, the digital audio input signals having been previously utilized as input for the first encoded audio output signal;

applying an audio processing modification to the received digital audio input signals utilizing apparatus specific information comprising acoustic information of the apparatus, to produce an intermediate audio signal;

encoding the intermediate audio signal to produce a second encoded audio output signal; and replacing the first encoded audio output signal with the second encoded audio output signal in the data set.

2. The method as claimed in claim 1, wherein the apparatus specific information comprises information about a configuration of the microphone array.

3. The method as claimed in claim 1, wherein the audio processing modification comprises at least two of the following: generating, from the received digital audio input signals, the intermediate audio signal having a specified audio channel amount; modifying a spectral characteristics of the received digital audio input signals; and selecting an audio codec to be used in the encoding the intermediate audio signal.

4. The method as claimed in claim 3, wherein the audio channel amount includes two channels for stereo sound and at least three channels for surround sound.

5. The method as claimed in claim 3, wherein the modifying the spectral characteristics comprises high-pass filtering the received digital audio input signals.

6. The method as claimed in claim 1, wherein the encoding the intermediate audio signal comprises one of advanced audio coding the intermediate audio signal and dolby digital plus encoding the intermediate audio signal.

7. The method as claimed in claim 1, wherein the data set further comprises a video signal captured with the apparatus and associated with the first encoded audio output signal.

8. The method as claimed in claim 1, wherein the method is performed by one of the apparatus having the microphone array and a service providing network based storage.

9. The method as claimed in claim 1, wherein the digital audio input signals comprise one of uncompressed and lossless compressed digital audio input signals.

10. The method as claimed in claim 9, wherein the uncompressed digital audio input signals comprise pulse code modulation signals.

11. The method as claimed in claim 1, wherein the data set comprises MPEG-4 data set.

12. An apparatus, comprising:

a microphone array; and a processor programmed to:

receive a data set comprising a first encoded audio output signal and associated pre-stored digital audio input signals captured from the microphone array that captures the digital audio input signals using direct audio capture, the digital audio input signals having been previously utilized as input for the first encoded audio output signal; and to apply an audio processing modification to the received digital audio input signals utilizing apparatus specific information comprising acoustic information of the apparatus, to produce an intermediate audio signal;

encode the intermediate audio signal to produce a second encoded audio output signal; and replace the first encoded audio output signal with the second encoded audio output signal in the data set.

13. The apparatus as claimed in claim 12, wherein the apparatus specific information comprises information about a configuration of the microphone array.

14. The apparatus as claimed in claim 12, wherein the audio processing modification comprises at least one of: generating, from the received digital audio input signals, the intermediate audio signal having a specified audio channel amount; modifying a spectral characteristics of the received digital audio input signals; and selecting an audio codec to be used in the encoding the intermediate audio signal.

15. The apparatus as claimed in claim 14, wherein the audio channel amount includes two channels for stereo sound and at least three channels for surround sound, and the modifying the spectral characteristics comprises high-pass filtering the received digital audio input signals.

16. The apparatus as claimed in claim 12, wherein the processor is further programmed to perform the encoding of the intermediate audio signal utilizing one of advanced audio coding and dolby digital plus encoding.

17. The apparatus as claimed in claim 12, wherein the data set further comprises a video signal captured with the apparatus and associated with the first encoded audio output signal.

18. The apparatus as claimed in claim 12, wherein the digital audio input signals comprise one of uncompressed and lossless compressed digital audio input signals.

19. The apparatus as claimed in claim 12, wherein the microphone array comprises at least two microphones.

20. A computer-readable storage medium comprising executable instructions for causing at least one processor of an apparatus to perform operations comprising:

receiving a data set comprising a first encoded audio output signal and associated pre-stored digital audio input signals captured from a microphone array of an apparatus that captures the digital audio input signals using direct audio capture, the digital audio input signals having been previously utilized as input for the first encoded audio output signal;

applying an audio processing modification to the received digital audio input signals utilizing apparatus specific information comprising acoustic information of the apparatus, to produce an intermediate audio signal;

encoding the intermediate audio signal to produce a second encoded audio output signal; and replacing the first encoded audio output signal with the second encoded audio output signal in the data set.

* * * * *